US010281172B2

(12) United States Patent
Krowech et al.

(10) Patent No.: US 10,281,172 B2
(45) Date of Patent: May 7, 2019

(54) LINER FABRICATION TOOL

(71) Applicant: HRST, Inc., Eden Prairie, MN (US)

(72) Inventors: Robert James Krowech, Eden Prairie, MN (US); Darryl Nagel, Hudson, WI (US)

(73) Assignee: HRST, Inc., Eden Prairie, MN (US)

( * ) Notice: Subject to any disclaimer, the term of this patent is extended or adjusted under 35 U.S.C. 154(b) by 295 days.

(21) Appl. No.: 15/280,489

(22) Filed: Sep. 29, 2016

(65) Prior Publication Data

US 2017/0087672 A1 Mar. 30, 2017

Related U.S. Application Data

(60) Provisional application No. 62/234,379, filed on Sep. 29, 2015.

(51) Int. Cl.
*F24H 8/00* (2006.01)
*B25B 31/00* (2006.01)

(52) U.S. Cl.
CPC ..... *F24H 8/00* (2013.01); *B25B 31/005* (2013.01); *Y10T 29/53896* (2015.01); *Y10T 29/53909* (2015.01)

(58) Field of Classification Search
CPC ..... B25B 31/00; B25B 31/005; B25B 5/08; B25B 7/06; B25C 11/00; B25C 11/02; Y10T 29/53896; Y10T 29/53909
See application file for complete search history.

(56) References Cited

U.S. PATENT DOCUMENTS 564,122 A * 7/1896 Thayer et al. ..... B25C 11/00 254/21
1,079,843 A * 11/1913 Dibert ..... B25C 11/02 254/22
1,877,620 A * 9/1932 Thoman ..... B60J 1/00 29/267
2,719,694 A * 10/1955 Husa ..... B25C 11/00 254/24
3,769,683 A * 11/1973 Krekeler ..... E02F 9/2891 254/22
4,606,106 A * 8/1986 Dutton ..... B25B 27/0028 29/235
4,727,900 A * 3/1988 Dooling ..... E03B 9/06 137/296
7,568,873 B1 * 8/2009 Rambo ..... F16B 37/0864 411/432

* cited by examiner

*Primary Examiner* — Tyrone V Hall, Jr.
(74) *Attorney, Agent, or Firm* — Vidas, Arrett & Steinkraus, P.A.

(57) ABSTRACT

A liner fabrication tool includes a handle engaged to a first cam support and a second cam support where each of the cam supports has forward edge. An axle extends between the first cam support and the second cam support. A gripper is rotatably engaged to the axle between the first cam support and the second cam support. The gripper includes a first wall, a second wall, and a base extending between the first wall and the second wall, the base has an opening where the opening is positioned between and proximate to the forward edges. The opening receives a pin of a liner and insulation system where rotation of the handle in a forward direction applies leverage against the first cam support and the second cam support to bind the pin in the opening and compress the liner and insulation system immediately prior to welding.

16 Claims, 4 Drawing Sheets

Fig. 7

LINER FABRICATION TOOL

CROSS-REFERENCE TO RELATED APPLICATIONS

This application claims the benefit of U.S. Provisional Patent Application Ser. No. 62/234,379 filed Sep. 29, 2015, which is incorporated by reference herein in its entirety.

FIELD OF THE INVENTION

The present invention in general relates to a tool used in the fabrication of liner insulation panels which are used to provide thermal insulation in the boiler industry.

BACKGROUND OF THE INVENTION

Heat Recovery Steam Generators and many styles of Waste Heat Boilers have an internal liner and insulation system to protect the outer casing from hot exhaust gas. If the internal liner and insulation system fails, then many problems may occur including outer casing overheating and buckling, hot exhaust gas leaks, and insulation fouling of finned tubes and catalyst systems. In addition, the liner and insulation system may be exposed to more than 100 mile-per-hour exhaust gas velocities at a temperature of 1100° F. The exposure of the liner and insulation system to exhaust gas velocities at high temperature may cause vibration resulting in premature failure and increased maintenance/replacement expense.

The liner and insulation systems may be formed of: an outer pressure boundary which is commonly a ¼" metallic plate; a layer or multiple layers of insulation; an inner liner of sheet metal which is selected to be compatible to the inside temperature of the Boiler, Heat Recovery Steam Generator, or Waste Heat Boiler. The inner liner may be constructed in a "fish scale" arrangement to allow for thermal expansion. The liner and insulation systems may also include a series of pins which are solidly attached to the outer pressure boundary to support the inner liner in a desired position/location. Washers may be placed over the pins in order to sandwich the inner liner between washers, allowing thermal expansion and restricting motion perpendicular to the outer pressure boundary.

In the past various ways have been used to sandwich the liner sheets of a liner or insulation system. In some embodiments, threaded fasteners are used. Alternatively, the upper washer may be welded directly to a pin. In all cases it is desirable that the sandwiching of the layers of the inner liner and insulation be snug, thereby eliminating vibration of the liner perpendicular to the outer pressure boundary.

Currently non-threaded pins are used in the fabrication of the insulated liner systems used with Boiler Systems including but not being limited to Heat Recovery Steam Generators or Waste Heat Boilers. During the use of non-threaded pins the compression of the internal liner and insulation toward the outer casing, and the sandwiching of the insulation between the liners, has occurred through the use of a vice-grip or other clamping device being releasably engaged to the tip of the pin. A hammer is then used to strike the clamping device in a downward direction until the sandwiched materials are snug relative to each other. A fabricator/worker/welder will then apply a sufficiently sturdy weld to the pin and top washer interface, to hold the assembly in a compressed configuration. The clamping device is then removed from the weld located proximate to the pin and top washer interface.

Alternatively, a flexible pry bar may be tack-welded to the tip of the top washer as disposed on the pin above the inner liner. The fabricator will then pry the top washer downwardly, thereby compressing the internal liner, insulation, and outer casing together, and the sandwiching of the insulation between the liners. The fabricator will then apply a sufficiently sturdy weld to the pin and top washer interface in order to hold the compressed liner assembly in a compressed configuration. The fabricator then removes the pry bar by breaking the tack weld and weld out between the pry bar and the pin and top washer interface.

During assembly of the liner and insulation system a fabricator will apply external force to the top washer to compress the internal liner, insulation, and outer casing together. If the liner and insulation system including a pin and washer is on an area designated as a floor surface, then the worker or fabricator may stand on the washer to compress the internal liner, insulation, and outer casing together immediately prior to welding. If the internal liner, insulation, and outer casing are disposed on an area designated as a side wall or overhead such as a ceiling, then force to compress the internal liner, insulation, and outer casing together must be applied by another method.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All U.S. patents and applications and all other published documents mentioned anywhere in this application are incorporated herein by reference in their entirety.

Without limiting the scope of the invention, a brief description of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. § 1.72.

GENERAL DESCRIPTION OF THE INVENTION

In at least one embodiment the liner fabrication tool includes a gripper member where the gripper member is positioned for engagement over the tip of a pin of a liner and insulation system used in the boiler industry.

In some embodiments, the gripper member includes an opening which is slightly larger than the diameter of the pin.

In at least one alternative embodiment the gripper member is pivotally engaged to an axle, where the axle is fixedly engaged to a pair of cam support members.

In some alternative embodiments the pair of cam support members include a gripper pivot point which is offset from the pin.

In at least one alternative embodiment the axle extends between a first cam support member and a second cam support member.

In some embodiments, a handle is engaged to the first cam support member and the second cam support member.

In at least one alternative embodiment when the handle is manipulated in a forward and downward direction, the gripper member pulls upwardly and tilts for gripping of the pin.

In some embodiments as the handle is manipulated in a forward and downward direction, cam surfaces of the first cam support member and second cam support member engage a top washer which is disposed over the pin on top of the inner liner.

In at least one alternative embodiment when the handle is manipulated in a forward and downward direction, the gripper member seizes the pin, and the first cam surface and second cam surface apply a downward force to the top washer which compresses the inner liner against insulated materials disposed between the inner liner and the outer casing.

In some embodiments the seizing of the pin and the compression of the inner liner against the top washer establishes a space or opening below the gripper member and above the top washer which is sufficiently large to permit a fabricator to weld the top washer to the pin to secure the inner liner, insulating material, and outer casing in a compressed configuration.

In at least one embodiment, the weld is placed between the top washer and the pin to establish a pin and top washer interface.

In some embodiments, following the welding of the top washer to the pin, the handle may be manipulated in an upward and rearward direction to release the gripper member from the top of the pin and allow for the separation of the liner fabrication tool from the pin.

In at least one embodiment the use of the liner fabrication tool eliminates the need to tack weld a pry bar to the pin and later break the tack weld to separate the pry bar from the top washer.

In some embodiments, sufficient compression force is applied to the liner and insulation assembly, when the liner and insulation assembly is located as a floor surface, side wall surface, or overhead ceiling surface.

In at least one embodiment, the liner fabrication tool may be used by a fabricator/worker using one hand, freeing up the worker's other hand for welding of the top washer to the pin to establish the pin and top washer interface.

In at least one embodiment, a liner fabrication tool includes a handle engaged to a first cam support and a second cam support where each of the cam supports has forward edge. An axle extends between the first cam support and the second cam support. A gripper is rotatably engaged to the axle between the first cam support and the second cam support. The gripper includes a first wall, a second wall, and a base extending between the first wall and the second wall, the base has an opening where the opening is positioned between and proximate to the forward edges. The opening receives a pin of a liner and insulation system where rotation of the handle in a forward direction applies leverage against the first cam support and the second cam support to bind the pin in the opening and compress the liner and insulation system, immediately prior to welding.

DETAILED DESCRIPTION OF THE PREFERRED EMBODIMENTS

Figure 1:
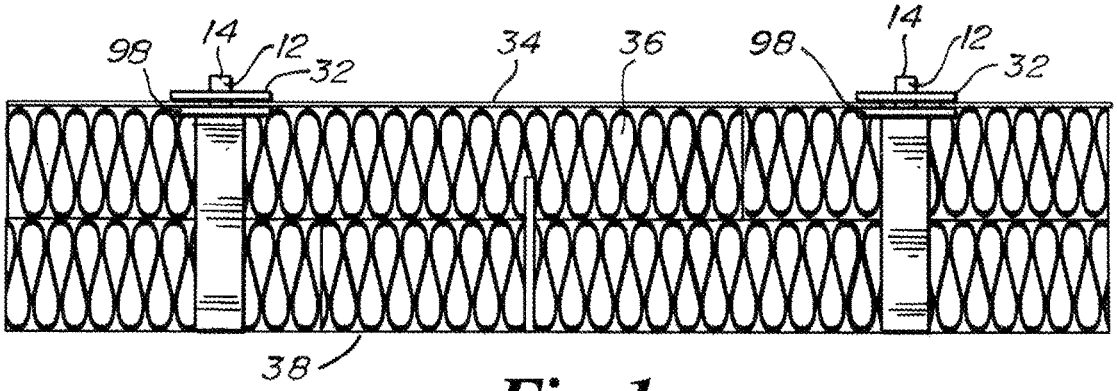
FIG. 1 depicts a cross sectional side view of one alternative embodiment of a liner and insulation system taken along the line 1-1 of FIG. 2.

In the following description, like reference characters designate like or corresponding elements throughout the drawings. Within this disclosure it is to be understood that such terms as "top," "above," "below," and other words similar thereto, have been selected for convenience and are not to be construed as limiting terms. Referring in more detail to the drawings, certain embodiments of the invention are described below.

In some embodiments the liner fabrication tool is generally referred to by the numeral 10. The liner fabrication tool 10 includes a gripping member 16.

In some embodiments as shown in FIGS. 3 through 8 the gripping member 16 is formed of a first support wall 40 and a second support wall 42. The first support wall 40 includes a first aperture 44 and the second support wall 42 includes a second aperture 46. A base 48 preferably extends between the bottom of the first support wall 40 and the bottom of the second support wall 42. A gripper opening 18 is preferably centrally located relative to the base 48.

In at least one embodiment the first support wall 40 includes a first rearward projecting section 60 and the second support wall 42 includes a second rearward projecting section 62. In some embodiments, the base 48 and gripping opening 18 is disposed forwardly from, and below, the first rearward projecting section 60 and the second rearward projecting section 62. In some embodiments, the first aperture 44 is disposed through the first rearward projecting section 60 and the second aperture 46 is disposed through the second rearward projecting section 62. The first rearward projecting section 60 and the second rearward projecting section 62 are located, and are constructed and arranged to enhance the leverage provided by the first cam support member 22 and second cam support member 24 during compression of the insulated material 36 disposed between the inner liner 34 and the outer casing 38.

In some embodiments, the gripper opening 18 is preferably constructed and arranged for placement over the pin tip 14 and pin 12 of a liner and insulation system. In some embodiments, the gripper opening 18 has a diameter which is slightly larger than the diameter of the pin 12 of the liner and insulation system.

In at least one alternative embodiment, a first gripper support 52 preferably extends between the top of the first support wall 40 and the top of the second support wall 42 opposite to the base 48. A second gripper support 54 also preferably extends between the top of the first support wall 40 and the top of the second support wall 42 opposite to the base 48.

In some embodiments a loop 56 may be engaged to the second gripper support 54. The loop 56 is constructed and arranged for engagement to an expandable member or spring 58. The expandable member or spring 58 is preferably constructed and arranged to position the gripper member 16 in a desired position relative to the liner fabrication tool 10.

In at least one embodiment, the first support wall 40, second support wall 42, base 48, first gripper support 52, second gripper support 54, and loop 56 are formed of metallic material having a sufficient strength and durability to not fracture or fail during use in the compression of insulated materials 36 disposed between an inner liner 34 and an outer casing 38.

In some embodiments the base 48 may be engaged to the bottom of the first support wall 40 and the bottom of the second support wall 42 by welding. In addition, the first gripper support 52 may be engaged to the top of the first support wall 40 and the top of the second support wall 42 by welding. Further, the second gripper support 54 may be engaged to the top of the first support wall 40 and the top of the second support wall 42 by welding and the loop 56 may also be engaged to the top of the second gripper support 54 by welding.

The liner and fabrication tool 10 also includes a handle 26. The handle 26 is preferably formed of solid metallic material which may be a rod. The handle 26 may have any desired length dimension between 8 inches and 20 inches. In some embodiments, the handle 26 may have a length dimension less than 8 inches and in other embodiments the handle 26 may have a length dimension longer than 20 inches.

In some embodiments the lower portion of the handle 26 includes a fastening member 64. The fastening member 64 may be permanently or releasably secured to the handle 26. Fastening member 64 is preferably disposed on the rear portion of the handle 26 and is preferably aligned in a location above the loop 56. The expandable member or spring 58 preferably is releasably secured at the bottom to the loop 56 and at the top to the fastening member 64.

In some embodiments, the handle 26 includes a first structural support 66 and a second structural support 68. The first structural support 66 and the second structural support 68 are preferably formed of metallic material and are welded to opposite sides of the handle 26 creating a plane. In some embodiments, the fastening member 64 is disposed on the handle 26 in a direction which is normal to the plane.

In some embodiments, the liner and fabrication tool 10 includes a first cam support member 22 and a second cam support member 24. The first cam support member 22 and the second cam support member 24 are preferably formed of metallic material. The first cam support member 22 includes a first lower cam edge 28 and the second cam support member 24 includes a second lower cam edge 30. The first cam support member 22 also includes a first top edge 74 which is opposite to the first lower cam edge 28. The second cam support member 24 includes a second top edge 76 which is opposite to the second lower cam edge 30.

In some embodiments, the first top edge 74 includes a first slot 78 and the second top edge 76 includes a second slot 80. In at least one alternative embodiment the first structural support 66 is inserted into the first slot 78 and welded therein. The second structural support 68 is inserted into the second slot 80 and welded therein. In some embodiments, the first slot 78 and the second slot 80 are centrally disposed with respect to the first top edge 74 and the second top edge 76 respectively.

In at least one embodiment, the first cam support member 22 includes a first forward edge 82 and a first rear edge 84. The second cam support member 24 includes a second forward edge 86 and a second rear edge 88.

In at least one embodiment, the first cam support member 22 includes a first axle opening identified generally by arrow 90 and the second cam support member 24 includes a second axle opening generally identified by arrow 92. The first axle opening 90 is preferably positioned proximate to the first rear edge 84 and above the first cam surface 28. The first axle opening 90 is preferably offset below and rearwardly relative to the center of the first cam support member 22 and proximate to each of the first rear edge 84 and first cam surface 28, in order to establish a rearwardly offset center of rotation for the first cam support member 22, relative to the gripper member 16, in order to increase leverage on the first cam surface 28 during use of the liner fabrication tool 10.

In at least one embodiment the second axle opening 92 is aligned relative to the first axle opening 90, where the second axle opening 92 is positioned proximate to the second rear edge 88 and above the second cam surface 30. The second axle opening 92 is preferably offset below and rearwardly relative to the center of the second cam support member 24, and is positioned proximate to each of the second rear edge 88, and second cam surface 30, in order to establish a rearwardly offset center of rotation for the second cam support member 24, relative to the gripping member 16, in order to increase leverage at the second cam surface 30 during use of the liner fabrication tool 10.

In some embodiments, the axle 20 is positioned through the first axle opening 90, the first aperture 44, the second axle opening 92, and the second aperture 46. The axle 20 may be rotatably engaged to the first cam support member 22, second cam support member 24, first support wall 40 and second support wall 42. It should be noted that the first aperture 44 is preferably located within the first rearward projecting section 60 and the second aperture 46 is preferably located within the second rearward projecting section 62.

In at least one embodiment, the axle 20 includes a head at one end and a washer and opening for a fastening member, such as a cotter pin, at the opposite end. An additional washer may be provided between the head and the second cam support member 24 at the discretion of an individual.

The head and cotter pin are used to prevent separation of the axle 20 and the gripper member 16 from the first cam support member 22 and the second cam support member 24. The axle 20 is preferably formed of metallic material and is sufficiently sturdy to not fracture and/or fail during use of the liner fabrication tool 10 during compression of the inner liner 34 and insulating material 36 relative to the outer casing 38.

In some embodiments a first spacer 94 is disposed on the axle 20 between the exterior of the first support wall 40 and the interior of the first cam support member 22. In some embodiments a second spacer 96 is rotatably disposed on the axle 20 between the exterior of the second support wall 42 and the interior of the second cam support member 24. The first spacer 94 and the second spacer 96 preferably are used to center the gripper member 16 between the first cam support member 22 and the second cam support member 24.

In at least one embodiment as depicted in FIG. 1 a lower washer 98 is disposed below the inner liner 34 proximate to the insulating materials 36. The inner liner 34 is then sandwiched between the top washer 32 and the lower washer 98. The top washer 32 and lower washer 98 provide compression surfaces to facilitate the compression of the first liner 34 and insulating materials 36 relative to the outer casing 38.

Figure 2:
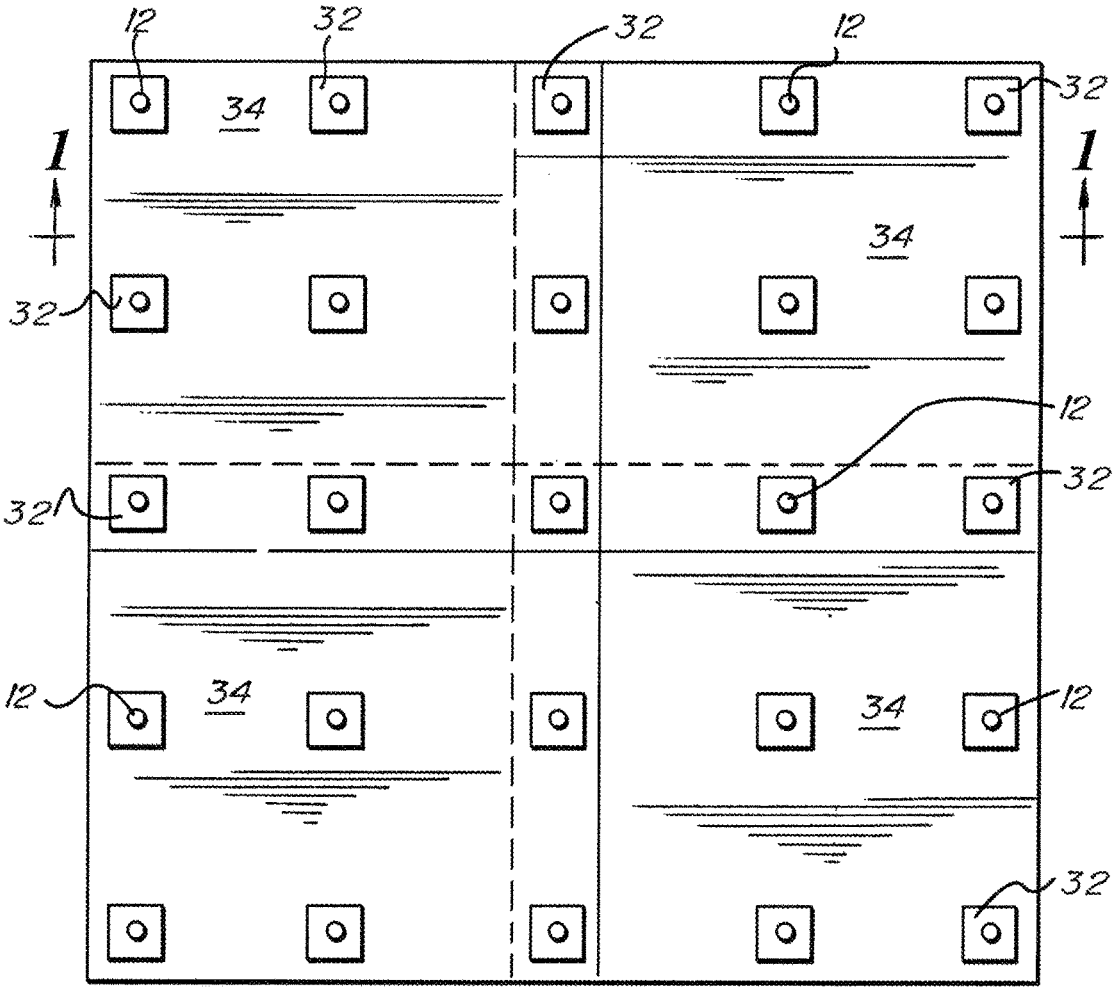
FIG. 2 depicts a top view of one alternative embodiment of a liner and insulation system.

In at least one embodiment as depicted in FIG. 2, four insulated panels are secured together as a portion of a liner and insulating system used within the boiler industry.

Figure 3:
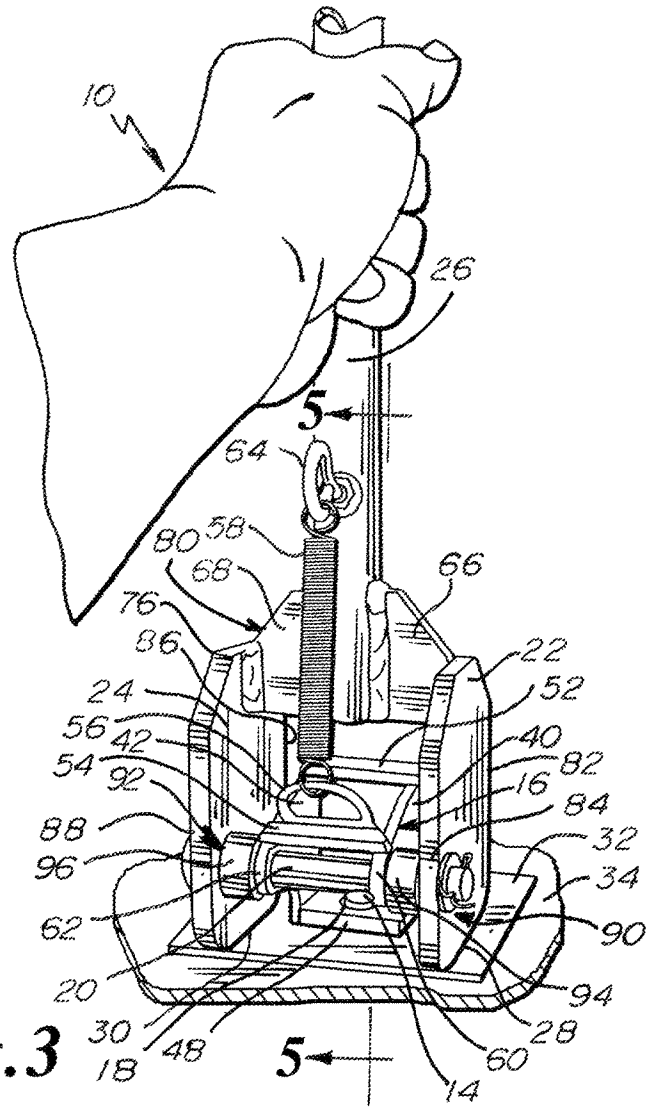
FIG. 3 depicts an environmental isometric view of one alternative embodiment of the invention.

In at least one embodiment as depicted in FIG. 3 the liner fabrication tool 10 is shown in an environmental isometric view where the gripper member 16 has been disposed over and is engaged to the pin 12 prior to the compression of the inner liner 34 and insulating materials 36 relative to the outer casing 38.

Figure 4:
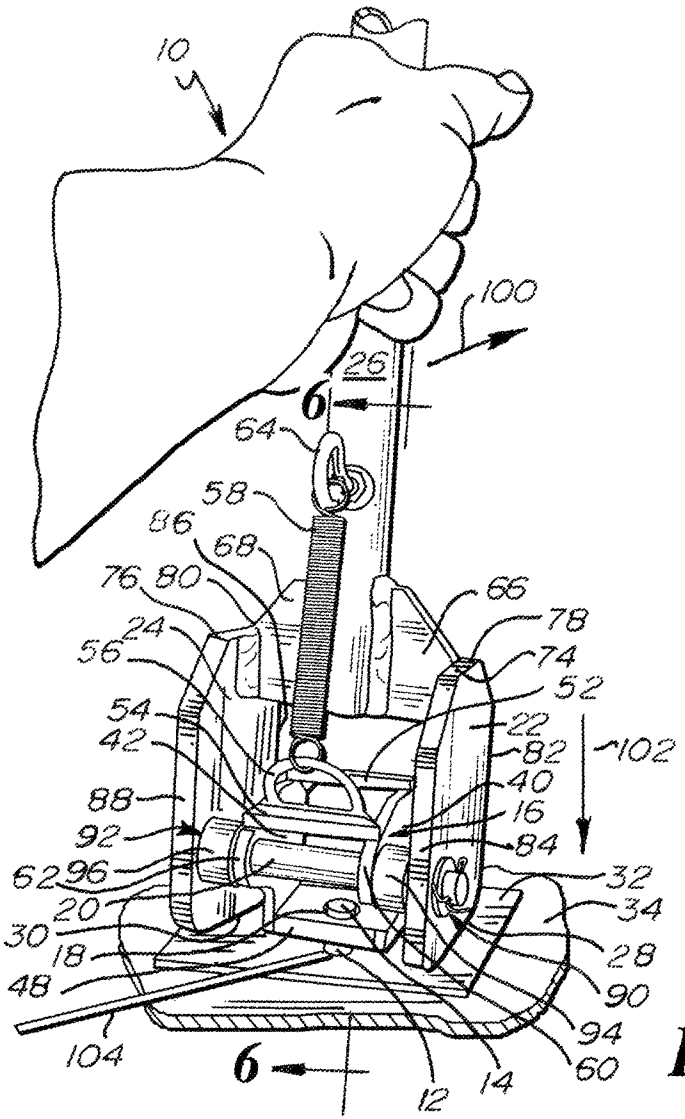
FIG. 4 depicts an alternative environmental isometric view of one alternative embodiment of the invention.

In at least one embodiment as depicted in FIG. 4 the handle 26 is rotated forwardly away from the axle 20 as represented by arrow 100. The rotation of the handle 26 in the direction of arrow 100 places a downward compression force on the forward edges of the first cam surface 28 and second cam surface 30 upon the top washer 32 and inner liner 34 as depicted by arrow 102. The downward compression force on the forward edges of the first cam surface 28 and the second cam surface 30 in turn causes the binding of the opening 18 against the pin 12 causing the elevation of the rear edge of the base 48. The elevation of the rear edge of the base 48 establishes a sufficiently large space to enable a fabricator/worker/welder to insert a welding device 104 below the base 48 and against the pin 12 in order to weld the pin 12 to the top washer 32 following the compression of the top washer 32, inner liner 34 and insulating materials 36 relative to the outer casing 38.

Figures 5, 6, 7:
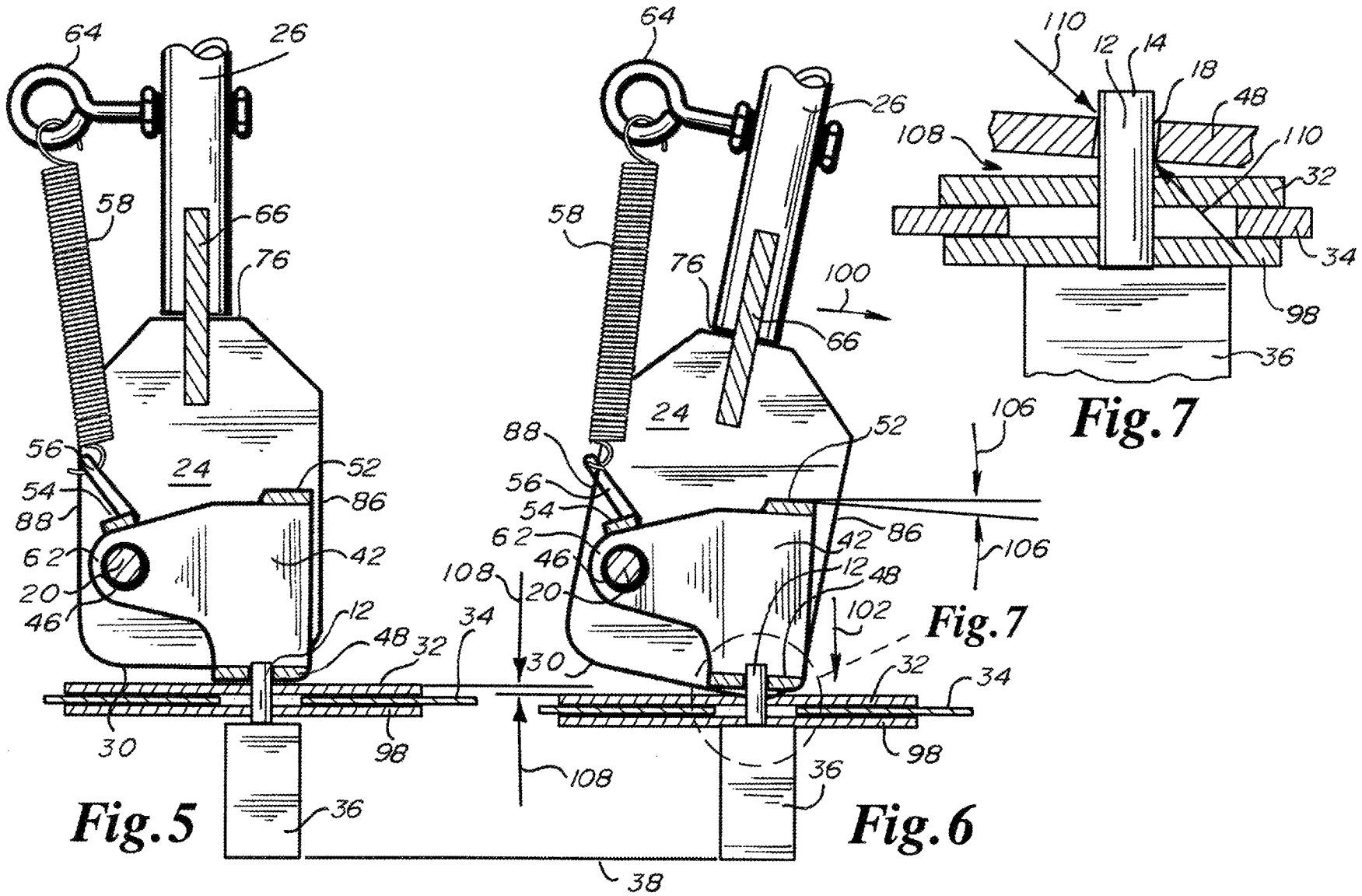
FIG. 5 depicts a partial cross-sectional side view of one alternative embodiment of the invention taken along the line 5-5 of FIG. 3.
FIG. 6 depicts a partial cross-sectional side view of one alternative embodiment of the invention taken along the line 6-6 of FIG. 4.
FIG. 7 depicts an exploded detail partial cross-sectional side view of one alternative embodiment of the invention taken along the line 6-6 of FIG. 4.

In some embodiments as depicted in FIG. 5 the base 48 of the gripper member 16 is flush with the upper surface of the top washer 32.

In some embodiments as depicted in FIG. 6 the rotation of the handle 26 in the forward direction 100 away from the axle 20 rotates the forward edge of the first cam surface 28 and second cam surface 30 to compress the top washer 32, inner liner 34 and insulating materials 36 relative to the outer casing 38.

The amount of forward rotation of the first cam support member 22 and second cam support member 24 is depicted by angle designated by arrows 106. The forward rotation of the handle 26 as represented by arrow 100, as well as the forward rotation of the first cam support member 22 and second cam support member 24 on the first cam surface 28 and second cam surface 30, causes the binding of the pin 12 in the opening 18 and the rotation of the rear edge of the base 48 in an upward direction to establish space indicated by arrows 108.

In some embodiments referring to FIG. 7, the binding of the pin 12 within opening 18 is illustrated by arrows 110, where the lower forward edge of opening 18 contacts and binds with the forward side of the pin 12 and a decreased depth. The upper rearward edge of opening 18 contacts and binds with the rear side of the pin 12 at a higher location or depth. The binding of the pin 12 and the gripper member 16 via the opening 18 enables the handle 16 to exert downward leverage on the forward edges of the first cam surface 28 and second cam surface 30 against the top washer 32 to compress the top washer 32, inner liner 34 and insulated materials 36 relative to the outer casing 38. The compression of the top washer 32, inner liner 34, and insulated materials 36 establishes space 108 enabling the welding of the top washer 32 to the pin 12, to retain the top washer 32, inner layer 34, and insulating materials 36 in a compressed configuration.

Figure 8:
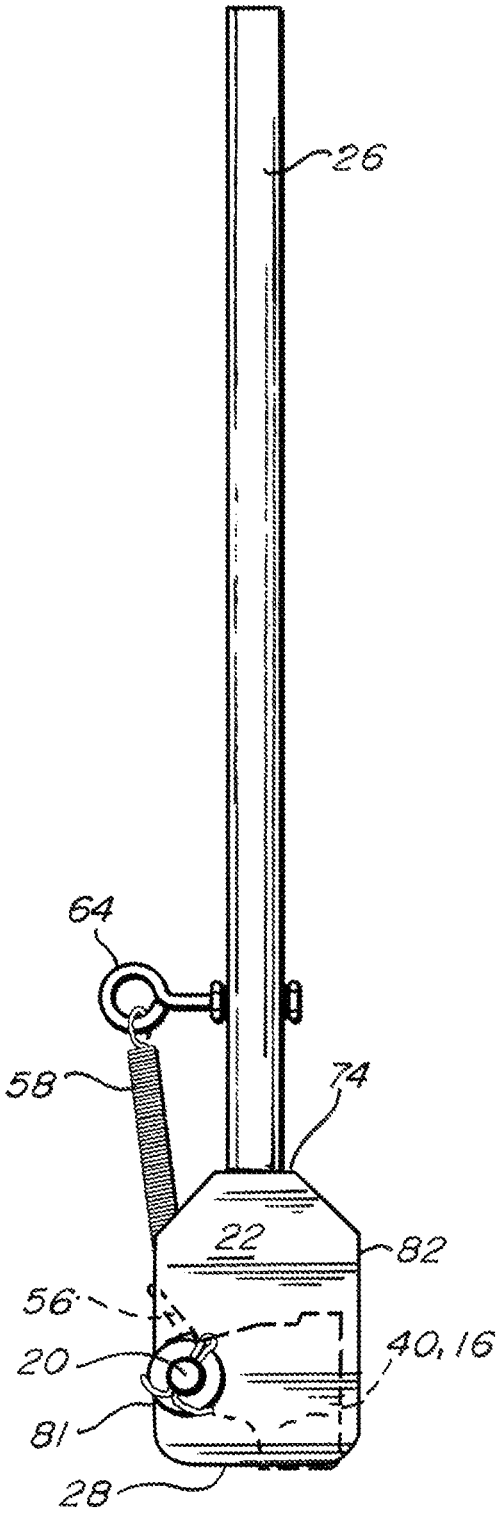
FIG. 8 depicts a side environmental partial phantom line view of one alternative embodiment showing the use of the invention.

In some embodiments as shown in FIG. 8 the gripper member 16 is shown in phantom line. When welding is complete, a worker may rotate the handle 26 in a direction opposite to arrow 100 which will cause the gripping member 16 to release the pin 12 and the separation of the liner fabrication tool 10 from the pin 12.

In a first alternative embodiment, a liner fabrication tool comprises a handle engaged to a first cam support member and a second cam support member, the first cam support member has a first forward edge and the second cam support member has a second forward edge, an axle extends between the first cam support member and the second cam support member, and a gripper member is rotatably engaged to the axle between the first cam support member and the second cam support member, the gripper member comprises a first support wall, a second support wall, and a base extending between the first support wall and the second support wall, the base comprises a centrally disposed opening.

In a second alternative embodiment according to the first alternative embodiment the first cam support member has a first rear edge and the second cam support member has a second rear edge, each of the first cam support member and the second cam support member having a center, wherein the axle is disposed rearwardly from the center and forwardly from the first rear edge and the second rear edge, and further wherein the base is disposed forwardly from the center and rearwardly from the first forward edge and the second forward edge.

In a third alternative embodiment according to the second alternative embodiment, the first support wall comprises a first aperture and the second support wall comprises a second aperture, the axle passes through the first aperture and the second aperture.

In a fourth alternative embodiment according to the third alternative embodiment, the first support wall comprises a first rearward projecting section and the second support wall comprises a second rearward projecting section, wherein the first aperture is disposed through the first rearward projecting section and the second aperture is disposed through the second rearward projecting section.

In a fifth alternative embodiment according to the fourth alternative embodiment, the axle is rearwardly and downwardly offset from the center, the axle being constructed and arranged to establish an offset center of rotation for the first cam support member and the second cam support member.

In a sixth alternative embodiment according to the fifth alternative embodiment, the first cam support member comprises a first cam surface and the second cam support member comprises a second cam surface.

In a seventh alternative embodiment according to the sixth alternative embodiment, the liner fabrication tool further comprises at least one gripper support, the at least one gripper support being engaged to the first support wall and the second support wall opposite to the base.

In an eighth alternative embodiment according to the seventh alternative embodiment, the liner fabrication tool further comprises an expandable member, the expandable member being engaged to the handle and the at least one gripper support.

In a ninth alternative embodiment according to the eighth alternative embodiment, the liner fabrication tool further comprises a first spacer and a second spacer, the first spacer being disposed on the axle between the first support wall and the first cam support member and the second spacer being disposed on the axle between the second support wall and the second cam support member.

In a tenth alternative embodiment according to the ninth alternative embodiment, the opening is constructed and arranged to receive a pin of a liner and insulation system and the rotation of the handle in a forward direction applies leverage against the first cam support member and the second cam support member to bind the pin in the opening and compress the liner and insulation system immediately prior to welding.

In an eleventh alternative embodiment, a liner fabrication tool comprises a handle engaged to a first cam support member and a second cam support member, the first cam support member having a first forward edge and a first rear edge, the second cam support member having a second forward edge and a second rear edge, and each of the first cam support member and the second cam support member having a center, an axle extending between the first cam support member and the second cam support member, the axle being disposed rearwardly from the center and forwardly from the first rear edge and the second rear edge, and a gripper member rotatably engaged to the axle between the first cam support member and the second cam support member, the gripper member comprising a first support wall, a second support wall, and a base extending between the first support wall and the second support wall wherein the base is disposed forwardly from the center and rearwardly from the first forward edge and the second forward edge, the base comprising a centrally disposed opening, wherein the opening is constructed and arranged to receive a pin of a liner and insulation system and further wherein rotation of the handle in a forward direction applies leverage against the first cam support member and the second cam support member to bind the pin in the opening and compress the liner and insulation system.

In a twelfth alternative embodiment according to the eleventh alternative embodiment, the first support wall comprises a first aperture and the second support wall comprises a second aperture, the axle passing through the first aperture and the second aperture.

In a thirteenth alternative embodiment according to the twelfth alternative embodiment the first support wall comprises a first rearward projecting section and the second support wall comprises a second rearward projecting section, wherein the first aperture is disposed through the first rearward projecting section and the second aperture is disposed through the second rearward projecting section.

In a fourteenth alternative embodiment according to the thirteenth alternative embodiment, the axle is rearwardly and downwardly offset from the center, the axle being constructed and arranged to establish an offset center of rotation for the first cam support member and the second cam support member.

In a fifteenth alternative embodiment according to the fourteenth alternative embodiment the first cam support member comprises a first cam surface and the second cam support member comprises a second cam surface.

In a sixteenth alternative embodiment according to the fifteenth alternative embodiment the liner fabrication tool further comprises at least one gripper support, the at least one gripper support being engaged to the first support wall and the second support wall opposite to the base.

In a seventeenth alternative embodiment according to the sixteenth alternative embodiment the liner fabrication tool further comprises an expandable member, the expandable member being engaged to the handle and the at least one gripper support.

In an eighteenth alternative embodiment according to the seventeenth alternative embodiment the liner fabrication tool further comprises a first spacer and a second spacer, the first spacer being disposed on the axle between the first support wall and the first cam support member, and the second spacer being disposed on the axle between the second support wall and the second cam support member.

This completes the description of the preferred and alternate embodiments of the invention. Those skilled in the art may recognize other equivalents to the specific embodiment described herein which equivalents are intended to be encompassed by the claims attached hereto.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

What is claimed is:

1. A liner fabrication tool comprising:

a handle engaged to a first cam support member and a second cam support member, said first cam support member having a first forward edge and said second cam support member having a second forward edge;

an axle extending between said first cam support member and said second cam support member; and a gripper member rotatably engaged to said axle between said first cam support member and said second cam support member, said gripper member comprising a first support wall, a second support wall, and a base extending between said first support wall and said second support wall, said base comprising a centrally disposed opening; and each of said first cam support member and said second cam support member having a center, said first support wall comprising a first rearward projecting section disposed rearwardly from said center, said second support wall comprising a second rearward projecting section disposed rearwardly from said center, said axle being engaged to said first rearward projecting section and said second rearward projecting section, and said base being positioned forwardly from said center.

2. The liner fabrication tool according to claim 1, said first cam support member having a first rear edge and said first forward edge and said second cam support having a second rear edge and said second forward edge, wherein said axle is disposed rearwardly from said center and forwardly from said first rear edge and said second rear edge, and further wherein said base is disposed forwardly from said center and rearwardly from said first forward edge and said second forward edge.

3. The liner fabrication tool according to claim 2, said first support wall comprising a first aperture and said second support wall comprising a second aperture, said axle passing through said first aperture and said second aperture.

4. The liner fabrication tool according to claim 3, wherein said axle is rearwardly and downwardly offset from said center, said axle being constructed and arranged to establish an offset center of rotation for said first cam support member and said second cam support member.

5. The liner fabrication tool according to claim 4, said first cam support member comprising a first cam surface and said second cam support member comprising a second cam surface.

6. The liner fabrication tool according to claim 5, further comprising at least one gripper support, said at least one gripper support being engaged to said first support wall and said second support wall opposite to said base.

7. The liner fabrication tool according to claim 6, further comprising an expandable member, said expandable member being engaged to said handle and said at least one gripper support.

8. The liner fabrication tool according to claim 7, further comprising a first spacer and a second spacer, said first spacer being disposed on said axle between said first support wall and said first cam support member and said second spacer being disposed on said axle between said second support wall and said second cam support member.

9. The liner fabrication tool according to claim 8, wherein said opening is constructed and arranged to receive a pin of a liner and insulation system and further wherein rotation of said handle in a forward direction applies leverage against said first cam support member and said second cam support member to bind said pin in said opening and compress said liner and insulation system.

10. A liner fabrication tool comprising:

a handle engaged to a first cam support member and a second cam support member, said first cam support member having a first forward edge and a first rear edge, said second cam support member having a second forward edge and a second rear edge, and each of said first cam support member and said second cam support member having a center;

an axle extending between said first cam support member and said second cam support member, said axle being disposed rearwardly from said center and forwardly from said first rear edge and said second rear edge; and a gripper member rotatably engaged to said axle between said first cam support member and said second cam support member, said gripper member comprising a first support wall, a second support wall, and a base extending between said first support wall and said second support wall, said first support wall comprising a first rearward projecting section and said second support wall comprising a second rearward projecting section, said axel being rotatably engaged to said first rearward projecting section and said second rearward projecting section wherein said base is disposed forwardly from said center and rearwardly from said first forward edge and said second forward edge, said base comprising a centrally disposed opening, wherein said opening is constructed and arranged to receive a pin of a liner and insulation system and further wherein rotation of said handle in a forward direction applies leverage against said first cam support member and said second cam support member to bind said pin in said opening and compress said liner and insulation system.

11. The liner fabrication tool according to claim 10, said first support wall comprising a first aperture and said second support wall comprising a second aperture, said axle passing through said first aperture and said second aperture.

12. The liner fabrication tool according to claim 11, wherein said axle is rearwardly and downwardly offset from said center, said axle being constructed and arranged to establish an offset center of rotation for said first cam support member and said second cam support member.

13. The liner fabrication tool according to claim 12, said first cam support member comprising a first cam surface and said second cam support member comprising a second cam surface.

14. The liner fabrication tool according to claim 13, further comprising at least one gripper support, said at least one gripper support being engaged to said first support wall and said second support wall opposite to said base.

15. The liner fabrication tool according to claim 14, further comprising an expandable member, said expandable member being engaged to said handle and said at least one gripper support.

16. The liner fabrication tool according to claim 15, further comprising a first spacer and a second spacer, said first spacer being disposed on said axle between said first support wall and said first cam support member and said second spacer being disposed on said axle between said second support wall and said second cam support member.

* * * * *